US011653147B2

(12) United States Patent
Boldt et al.

(10) Patent No.: US 11,653,147 B2
(45) Date of Patent: May 16, 2023

(54) HEARING DEVICE WITH MICROPHONE SWITCHING AND RELATED METHOD

(71) Applicant: GN Hearing A/S, Ballerup (DK)

(72) Inventors: Jesper B. Boldt, Ballerup (DK); Fredrik Gran, Ballerup (DK)

(73) Assignee: GN HEARING A/S, Ballerup (DK)

( * ) Notice: Subject to any disclaimer, the term of this patent is extended or adjusted under 35 U.S.C. 154(b) by 0 days.

(21) Appl. No.: 17/377,336

(22) Filed: Jul. 15, 2021

(65) Prior Publication Data

US 2021/0345042 A1 Nov. 4, 2021

(30) Foreign Application Priority Data

Aug. 14, 2020 (DK) ..... PA202070531

(51) Int. Cl.
*H04R 3/00* (2006.01)

(52) U.S. Cl.
CPC ..... *H04R 3/005* (2013.01)

(58) Field of Classification Search
CPC ..... H04R 3/005; H04R 25/00
USPC ..... 381/23.1, 119, 312
See application file for complete search history.

(56) References Cited

U.S. PATENT DOCUMENTS

| | | | | |
|---|---|---|---|---|
| 2012/0263322 | A1* | 10/2012 | Lovitt | G10L 21/02 381/119 |
| 2018/0040327 | A1* | 2/2018 | Ono | H04R 3/005 |
| 2021/0092531 | A1* | 3/2021 | De Haan | H04R 25/453 |
| 2021/0408991 | A1* | 12/2021 | Klovning | H03G 3/34 |

FOREIGN PATENT DOCUMENTS

| | | | | |
|---|---|---|---|---|
| EP | 2 806 660 | | 11/2014 | |
| EP | 2806660 | A1 * | 11/2014 | H04R 25/407 |
| EP | 2 849 462 | | 3/2015 | |
| EP | 3185588 | | 6/2017 | |
| EP | 3361753 | | 8/2018 | |
| EP | 3 481 085 | | 5/2019 | |
| EP | 3926982 | A2 * | 12/2021 | G10L 25/51 |
| WO | WO 2016/063220 | | 4/2016 | |

OTHER PUBLICATIONS

Foreign Office Action dated Feb. 8, 2021 for Danish Patent Application No. PA 2020 70531.
Extended European Search Report for EP Patent Appln. No. 21185272.8 dated Jan. 7, 2022.

* cited by examiner

*Primary Examiner* — William A Jerez Lora
(74) *Attorney, Agent, or Firm* — Vista IP Law Group, LLP

(57) ABSTRACT

A hearing device includes: first and second primary microphones for provision of first and second primary microphone input signals; a secondary microphone for provision of a secondary microphone input signal; a mixing module for provision of a mixer output based on a primary mixer input and/or a secondary mixer input, primary mixer input being based on the first and second primary microphone input signals, the secondary mixer input being based on the secondary microphone input signal; a processing unit configured to provide an electrical output signal; and a receiver for converting the electrical output signal to an audio output signal; wherein the mixing controller is configured to increase an amount of the secondary mixer input in the mixer output for a time period after a presence of a sound event is determined, and reduce the amount of the secondary mixer input in the mixer output after the time period.

19 Claims, 6 Drawing Sheets

HEARING DEVICE WITH MICROPHONE SWITCHING AND RELATED METHOD

RELATED APPLICATION DATA

This application claims priority to, and the benefit of, Danish Patent Application No. PA 2020 70531 filed on Aug. 14, 2020. The entire disclosure of the above application is expressly incorporated by reference herein.

FIELD

The present disclosure relates to a hearing device and related methods including a method of operating a hearing device. In particular, a hearing device with both an in-ear microphone and one or more behind-the-ear microphones and related method are disclosed.

BACKGROUND

For hearing device designers, spatial perception and the ability to perceive spatial cues play an important role in a hearing device user's ability to understand speech and crucial for complex listening environments. On the other hand, feedback and instabilities in hearing aids continue to represent challenges to hearing device designers and engineers in particular when microphones and receiver are placed near each other, for example in a MaRie (Microphone and Receiver in ear) hearing device.

SUMMARY

Accordingly, there is a need for hearing devices and methods with improved spatial perception and stability of the hearing device.

A hearing device is disclosed, the hearing device comprising a first housing configured as a behind-the-ear housing to be worn behind the pinna of a user; a second housing configured as an earpiece housing to be worn in or at the ear canal of a user; a wire connecting the first housing and the second housing; a primary set of microphones arranged in the first housing, the primary set of microphones including a primary first microphone for provision of a primary first microphone input signal, and a primary second microphone for provision of a primary second microphone input signal; a secondary microphone arranged in the second housing for provision of a secondary microphone input signal; a mixing module for provision of a mixer output based on a primary mixer input and a secondary mixer input, wherein the primary mixer input optionally is based on the primary first microphone input signal and/or the primary second microphone input signal, and the secondary mixer input is based on the secondary microphone input signal; a mixing controller configured to control the mixing module; a processor for processing the mixer output and providing an electrical output signal based on mixer output; and a receiver for converting the electrical output signal to an audio output signal. The mixing controller is optionally configured to determine presence of a switch event, such as a sound event, and in accordance with a determination that a sound event is present, control the mixing module, such as increase an amount of the secondary mixer input in the mixer output for a time period and/or reduce the amount of the secondary mixer input in the mixer output after the time period.

Further, a method of operating a hearing device is disclosed, the hearing device comprising a first housing configured as a behind-the-ear housing to be worn behind the pinna of a user; a second housing configured as an earpiece housing to be worn in or at the ear canal of a user; a wire connecting the first housing and the second housing; a primary set of microphones arranged in the first housing, the primary set of microphones including a primary first microphone and a primary second microphone; a secondary microphone arranged in the second housing; a mixing module; a mixing controller; a processor; and a receiver. The method comprises obtaining a primary first microphone input signal, e.g. with the primary first microphone; obtaining a primary second microphone input signal, e.g. with the primary second microphone; obtaining a secondary microphone input signal, e.g. with the secondary microphone; providing a primary mixer input based on the primary first microphone input signal and/or the primary second microphone input signal; providing a secondary mixer input based on the secondary microphone input signal; providing a mixer output based on the primary mixer input and/or the secondary mixer input; processing the mixer output for provision of an electrical output signal; and converting the electrical output signal to an audio output signal. In the method, providing a mixer output based on the primary mixer input and the secondary mixer input comprises determining presence of a switch event, such as a sound event; in accordance with determining presence of a sound event, controlling the mixing module, such as increasing an amount of the secondary mixer input in the mixer output for a time period and/or reducing the amount of the secondary mixer input in the mixer output after the time period.

It is an important advantage of the hearing device that improved spatial perception in a hearing device with increased stability is provided. Accordingly, the risk of feedback in the hearing device is reduced while spatial cues are preserved to a higher degree, which in turn provides an improved hearing device.

Further, the present disclosure provides improved user experience by improving speech intelligibility and reducing feedback or other instability in the hearing device.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
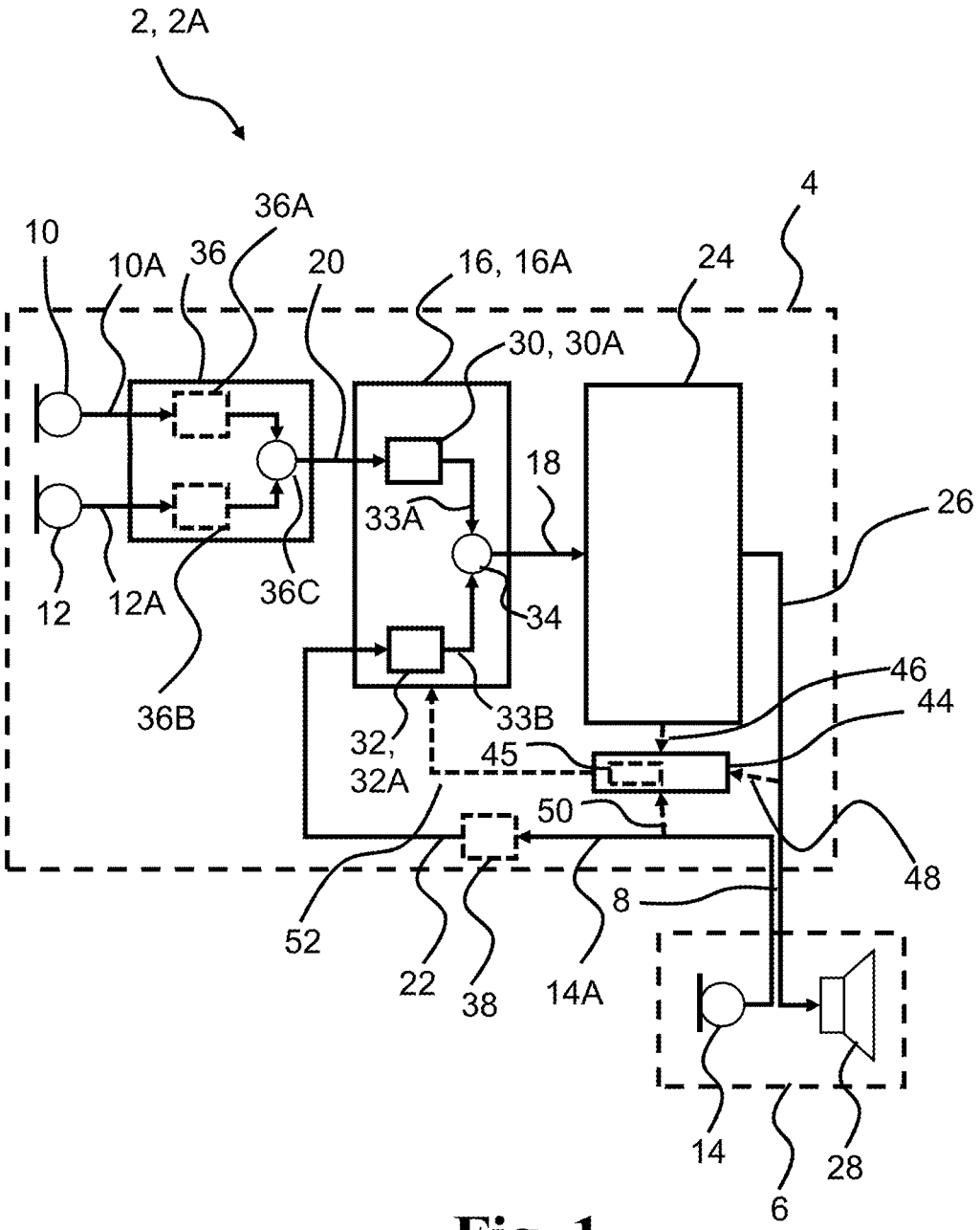
FIG. 1 schematically illustrates exemplary hearing devices.

Various exemplary embodiments and details are described hereinafter, with reference to the figures when relevant. It should be noted that the figures may or may not be drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

A hearing device is disclosed. The hearing device may be configured to be worn at an ear of a user and may be a hearable or a hearing aid, wherein the processor is configured to compensate for a hearing loss of a user.

The hearing device may be of the Microphone-and-Receiver-in ear (MaRIE) type. The hearing device may be a combined BTE and MaRIE type hearing device. The hearing device may be part of a binaural hearing system. Thus, the hearing device may be a binaural hearing device.

The hearing device comprises a first housing configured as a behind-the-ear housing to be worn behind the pinna of a user and a second housing configured as an earpiece housing to be worn in and/or at the ear canal of a user.

The hearing device comprises a wire connecting the first housing and the second housing. The wire comprises a plurality of conductors, e.g. three, four, five, six, or even eight or more conductors for electrically connecting electrical components of the first housing to electrical components of the second housing.

The hearing device comprises a primary set of microphones arranged in the first housing, the primary set of microphones including a primary first microphone for provision of a primary first microphone input signal also denoted x_1_1, and optionally a primary second microphone for provision of a primary second microphone input signal also denoted x_1_2. The primary first microphone may be denoted a front BTE (behind-the-ear) microphone and the primary second microphone may be denoted a rear BTE (behind-the-ear) microphone. The primary set of microphones may comprise a primary third microphone for provision of a primary third microphone input signal also denoted x_1_3.

The hearing device comprises a secondary microphone, also denoted secondary first microphone, arranged in the second housing for provision of a secondary microphone input signal also denoted x_2 or x_2_1. The secondary microphone may be denoted an in-ear microphone. The hearing device may comprise a plurality of secondary microphones arranged in the second housing. For example, a secondary second microphone, also denoted a canal microphone, may be arranged in the second housing for receiving intra-canal sounds, e.g. in order to allow for reduction in occlusion effects.

The hearing device comprises a mixing module for provision of a mixer output based on a primary mixer input and a secondary mixer input. The primary mixer input is optionally based on the primary first microphone input signal and/or the primary second microphone input signal, and the secondary mixer input is based on the secondary microphone input signal or a plurality of secondary microphone input signals.

The hearing device comprises a mixing controller configured to control the mixing module. The mixing controller is optionally configured to determine presence of a switch event, such as presence of a sound event; and in accordance with a determination that a switch event, such as a sound event, is present, control the mixing module, such as increase an amount of the secondary mixer input in the mixer output for a time period and/or reduce the amount of the secondary mixer input in the mixer output after the time period. In other words, the mixing controller optionally comprises a switch/sound event detector detecting or determining presence of a switch event/sound event.

In one or more exemplary hearing devices/methods, to increase an amount of the secondary mixer input in the mixer output for a time period comprises to increase a secondary coefficient or secondary coefficients applied to a component or components of the secondary mixer input.

The mixing controller is optionally configured to in accordance with a determination that a switch event, such as a sound event, is present, control the mixing module, such as reduce an amount of the primary mixer input in the mixer output for a time period and/or increase the amount of the primary mixer input in the mixer output after the time period.

The mixing controller is optionally configured to in accordance with a determination that a switch event, such as a sound event, is present, control the mixing module, such as reduce an amount of the primary mixer input in the mixer output for the time period. The mixing controller is optionally configured to increase an amount of the primary mixer input in the mixer output after the time period. The total gain applied to the primary mixer input and the secondary mixer input may be the same during and after the time period. In other words, the user does not experience an instant change in the sound volume when a sound event is detected.

In one or more exemplary hearing devices/methods, to reduce the amount of the secondary mixer input in the mixer output after the time period comprises to reduce a secondary coefficient or secondary coefficients applied to a component or components of the secondary mixer input.

The mixing controller is configured to determine the presence of a switch event, such as a sound event. A sound event may be a person starting to speak or a general increase in sound pressure or level, e.g. from a low level.

A switch event may be an event that is indicative of a situation where perception of directional or spatial cues is of high relevance. In one or more exemplary hearing devices/methods, a person abruptly or suddenly rotating his/her head may constitute a switch event. Thus, in one or more exemplary hearing devices, the hearing device may comprise a motion sensor, such as an accelerometer, and wherein the mixing controller is configured to determine presence of a switch event based on sensor output from the motion sensor. For example, presence of a switch event may be determined if the sensor output and/or a change in sensor output is larger than a threshold, e.g. where the sensor output is indicative of head motion.

The mixing controller is configured to, in accordance with a determination that a switch event, such as a sound event, is present, control the mixing module. For example, the mixing controller may be configured to increase an amount of the secondary mixer input in the mixer output for a time period and/or reduce the amount of the secondary mixer input in the mixer output after the time period in accordance with a determination that a switch event, such as a sound event, is present.

In one or more exemplary hearing devices/methods, the time period is in the range from 1 ms to 25 ms, such as in the range from 2 ms to 20 ms, e.g. in the range from 5 ms to 15 ms. The time period may be a fixed time period, e.g. set during fitting. The time period may be adaptive, e.g. determined during operation of the hearing device, e.g. based on one or more operating parameters of the hearing device and/or microphone input signals. The mixing controller may be configured to determine the time period, e.g.

based on one or more operating parameters of the hearing device and/or microphone input signals.

In one or more exemplary hearing devices/methods, to determine the presence of a switch event, such as a sound event, is based on one or more of the primary first microphone input signal, the primary second microphone input signal, and the secondary microphone input signal. For example, presence of a sound event may be detected if an input signal, such as primary first microphone input signal, primary second microphone input signal, secondary microphone input signal, or a combination thereof meets a threshold value, e.g. if a level of input or an increase in a level of input is larger than a threshold.

In one or more exemplary hearing devices, presence of a sound event is detected if a level (e.g. amplitude or power) in microphone input signal, such as secondary microphone input signal, increases by more than a threshold, e.g. a relative threshold, such as 50% or an absolute threshold, such as 3 dB. In one or more exemplary hearing devices, presence of a sound event is detected if a level (e.g. amplitude or power) in microphone input signal, such as secondary microphone input signal, exceeds a threshold, e.g. if the level is larger than 60 dB.

In one or more exemplary hearing devices/methods, to determine the presence of a switch event is based on one or more operating parameters of the hearing device, such as one or more of a program identifier, gains, such as a closed-loop gain, and/or feedback parameters.

In one or more exemplary hearing devices/methods, a program change may constitute a switch event. In other words, to determine the presence of a switch event may comprise to determine a change in hearing device program.

In one or more exemplary hearing devices/methods, wherein the mixing controller is configured to determine the time period, e.g. based on one or more operating parameters of the hearing device. In other words, the time period may be adaptive. Thus, the mixing controller may adaptively determine the time period, e.g. based on one or more of a program identifier, gains, such as a closed-loop gain, and/or feedback parameters of the hearing device. Thereby, improved, e.g. longer, use of the ITE microphone is provided for by maximizing the time period where the ITE microphone is used (with improved directional perception), while at the same time reducing the risk of or substantially avoiding instability issues in the hearing device.

In one or more exemplary hearing devices/methods, to increase an amount of the secondary mixer input in the mixer output for a time period comprises to increase an amount of the secondary mixer input in the mixer output and optionally to determine if a switching criterion is satisfied. In one or more exemplary hearing devices/methods, to reduce the amount of the secondary mixer input in the mixer output after the time period comprises to reduce the amount of the secondary mixer input in the mixer output in accordance with a determination that the switching criterion is satisfied. The switching criterion may be based on one or more gains, such as a closed-loop gain, and/or feedback parameters of the hearing device. In other words, the hearing device may use an increased amount of secondary mixer input in the mixer output until the mixing controller determines that instability is either present or imminent. For example, the switching criterion may be satisfied if a feedback parameter indicative of the risk of feedback reaches a threshold.

In one or more exemplary hearing devices/methods, to increase an amount of the secondary mixer input in the mixer output for a time period comprises to, at least for a component of the mixer output, solely base the mixer output on the secondary mixer input. In other words, primary gain(s)/coefficient(s) applied to the primary mixer input may be set to zero during the time period.

The mixing controller may be configured to, in accordance with a determination that a switch event, such as a sound event, is present, reduce an amount of the primary mixer input in the mixer output for a time period and/or increase the amount of the primary mixer input in the mixer output after the time period.

In one or more exemplary hearing devices/methods, to reduce an amount of the primary mixer input in the mixer output for a time period comprises to reduce a primary coefficient or primary coefficients applied to a component or components of the primary mixer input.

In one or more exemplary hearing devices/methods, to increase the amount of the primary mixer input in the mixer output after the time period comprises to increase a primary coefficient or primary coefficients applied to a component or components of the primary mixer input.

In one or more exemplary hearing devices/methods, to increase an amount of the secondary mixer input in the mixer output for a time period comprises to increase a secondary coefficient or secondary coefficients applied to a component or components of the secondary mixer input.

In one or more exemplary hearing devices/methods, to reduce an amount of the secondary mixer input in the mixer output after the time period comprises to gradually reduce a secondary coefficient applied to a component of the secondary mixer input during a switching time period. Thereby a smooth switching between ITE microphone and BTE-microphones may be provided.

In one or more exemplary hearing devices/methods, to reduce the amount of the secondary mixer input in the mixer output after the time period comprises to switch to a secondary coefficient applied to a component of the secondary mixer input.

In one or more exemplary hearing devices/methods, to reduce an amount of the secondary mixer input in the mixer output after the time period comprises to reduce a secondary coefficient or secondary coefficients applied to a component or components of the secondary mixer input.

In one or more exemplary hearing devices/methods, to increase an amount of the secondary mixer input in the mixer output for a time period comprises to determine a secondary coefficient or secondary coefficients, e.g. based on one or more operating parameters of the hearing device, such as based on one or more of a program identifier, gains, such as a closed-loop gain, and/or feedback parameters of the hearing device, and apply the secondary coefficient(s) to the secondary mixer input for provision of the mixer output. In other words, the secondary coefficient(s) applied in the mixing module may be adaptive.

In one or more exemplary hearing devices, the hearing device comprises a primary pre-processor connected to respective primary first microphone and primary second microphone for pre-processing the primary first microphone input signal and the primary second microphone input signal for provision of the primary mixer input. The primary pre-processor may comprise a first filter and/or a second filter for filtering the primary first microphone input signal and/or the primary second microphone input signal before adding the (optionally filtered/pre-processed) primary first microphone input signal and the (optionally filtered/pre-processed) primary second microphone input signal in adder of the first pre-processor. The first filter of the primary pre-processor may be a pinna-restoration filter, i.e. a filter configured to perform pinna-restoration of the primary first microphone input signal. The second filter of the primary pre-processor may be a pinna-restoration filter, i.e. a filter configured to perform pinna-restoration of the primary second microphone input signal.

In one or more exemplary hearing devices, the hearing device comprises a secondary pre-processor connected to the secondary microphone for pre-processing the secondary microphone input signal for provision of the secondary mixer input.

The hearing device comprises a processor for processing the mixer output. The processor provides an electrical output signal based on the mixer output (fed as processor input) to the processor. The processor may be configured for hearing compensation of a user's hearing loss. The processor may be a multi-channel processor. In other words, the processor input may be a multi-channel input, where each channel or (frequency) component is processed in parallel. The processor may be configured for feedback compensation and/or feedback cancellation.

The hearing device comprises a receiver for converting the electrical output signal to an audio output signal.

The mixing module is configured to mix the primary mixer input and the secondary mixer input for provision of the mixer output. In one or more exemplary hearing devices, the mixing module is configured to mix a primary first component of the primary mixer input and a secondary first component of the secondary mixer input for provision of a first component of the mixer output.

In one or more exemplary hearing devices/methods, to increase an amount of the secondary mixer input in the mixer output for a time period comprises to increase one or more secondary components, such as secondary first component and/or secondary second component, of the secondary mixer input.

In one or more exemplary hearing devices/methods, to reduce the amount of the secondary mixer input in the mixer output after the time period comprises to reduce one or more secondary components, such as secondary first component and/or secondary second component, of the secondary mixer input.

The primary first component of the primary mixer input and the secondary first component of the secondary mixer input may be broadband components.

The primary first component of the primary mixer input and the secondary first component of the secondary mixer input may be components of a first frequency band or first frequency bin. In one or more exemplary hearing devices/methods, a center frequency of the first frequency band/frequency bin is less than 1 kHz or even less than 400 Hz. A center frequency of the first frequency band/frequency bin may be in a range from 400 Hz to 2 kHz. In one or more exemplary hearing devices/methods, a center frequency of the first frequency band/frequency bin is larger than 1 kHz, such as larger than 2 kHz or even larger than 3 kHz.

In the hearing device, to mix the primary mixer input and the secondary mixer input for provision of the mixer output may comprise applying primary mixing filter(s) or primary gain(s)/coefficient(s) to the primary mixer input. The primary mixing filter(s) may be a time-domain filter or a frequency-domain filter. In other words, the mixing module may comprise primary filter(s) and/or primary gain unit(s) for receiving and processing the primary mixer input.

In the hearing device, to mix the primary mixer input and the secondary mixer input for provision of the mixer output may comprise applying secondary mixing filter(s) or secondary gain(s)/coefficient(s) to the secondary mixer input. The secondary mixing filter(s) may be a time-domain filter or a frequency-domain filter. In other words, the mixing module may comprise secondary filter(s) and/or secondary gain unit(s) for receiving and processing the secondary mixer input. In one or more exemplary hearing devices/methods, to increase an amount of the secondary mixer input in the mixer output for a time period comprises to increase one or more secondary gain(s)/coefficient(s) applied to the secondary mixer input. In one or more exemplary hearing devices/methods, to reduce an amount of the secondary mixer input in the mixer output comprises to reduce, e.g. set to zero, one or more secondary gain(s)/coefficient(s) applied to the secondary mixer input.

In one or more exemplary hearing devices/methods, to reduce an amount of the primary mixer input in the mixer output for a time period comprises to reduce one or more primary gain(s)/coefficient(s) applied to the primary mixer input. In one or more exemplary hearing devices/methods, to increase an amount of the primary mixer input in the mixer output comprises to increase, e.g. set to 1 or a value larger than 0.5, one or more primary gain(s)/coefficient(s) applied to the primary mixer input.

In the hearing device, to mix the primary mixer input and the secondary mixer input may comprise adding the output from the primary mixing filter(s)/primary gain unit(s) and the output from the secondary mixing filter(s)/secondary gain unit(s). In other words, the mixing module may comprise an adder (single-channel or multi-channel) connected to primary mixing filter(s)/primary gain unit(s) and secondary mixing filter(s)/secondary gain unit(s) for provision of an adder output as the mixer output.

The mixing module may be a multi-channel mixing module configured to perform mixing of a plurality of components/channels. In one or more exemplary hearing devices, the mixing module is optionally configured to mix a primary second component of the primary mixer input and a secondary second component of the secondary mixer input for provision of a second component of the mixer output. The mixing module is optionally configured to mix a primary second component of the primary mixer input and a secondary second component of the secondary mixer input for provision of a second component of the mixer output. The primary second component of the primary mixer input and the secondary second component of the secondary mixer input may be components of a second frequency band or second frequency bin, e.g. different from the first frequency band/frequency bin.

In one or more exemplary hearing devices and/or methods, to mix the primary first component, also denoted x_p_1, of the primary mixer input and the secondary first component x_s_1 of the secondary mixer input comprises to apply a first linear combination to the primary first component and the secondary first component for provision of the first component of the mixer output. In other words, the first component y_1 of the mixer output may be given as:

$$y_1=a_1*x_p_1+b_1*x_s_1,$$

where a_1 is a primary coefficient and b_1 is a secondary coefficient. The first linear combination, also denoted LC_1, may be defined by primary coefficient a_1 and secondary coefficient b_1.

The primary coefficient a_1 of the first linear combination may be larger than 0. The secondary coefficient b_1 of the first linear combination may be larger than 0. In one or more exemplary hearing devices and/or methods, the primary coefficient a_1 may be in the range between 0 and 1. In one or more exemplary hearing devices and/or methods, the secondary coefficient b_1 may be in the range between 0 and 1. In one or more exemplary hearing devices, the primary coefficient a_1 may be in the range between 0.1 and 0.9. and/or the secondary coefficient b_1 may be in the range between 0.1 and 0.9. The secondary coefficient b_1 may be less than 0.5.

In one or more exemplary hearing devices/methods, the sum of the primary coefficient and the secondary coefficient of a linear combination is 1. Thus, the sum of a_1 and b_1 may be 1.

In one or more exemplary hearing devices, the mixing module is configured to mix a primary second component, also denoted x_p_2, of the primary mixer input and a secondary second component, also denoted x_s_2, of the secondary mixer input for provision of a second component, also denoted y_2, of the mixer output.

The primary second component of the primary mixer input and the secondary second component of the secondary mixer input may be components of a second frequency band or second frequency bin. In one or more exemplary hearing devices/methods, a center frequency of the second frequency band/frequency bin is less than 1 kHz or even less than 400 Hz. A center frequency of the second frequency band/frequency bin may be in a range from 400 Hz to 2 kHz. In one or more exemplary hearing devices/methods, a center frequency of the second frequency band/frequency bin is larger than 1 kHz, such as larger than 2 kHz or even larger than 3 kHz. The second frequency band/frequency bin may be different from the first frequency band/frequency bin.

In one or more exemplary hearing devices, to mix the primary second component of the primary mixer input and the secondary second component of the secondary mixer input comprises to apply a second linear combination to the primary second component and the secondary second component for provision of the second component of the mixer output. In other words, the second component y_2 of the mixer output may be given as:

$$y_2=a_2*x_p_2+b_2*x_s_2,$$

where a_2 is a primary coefficient and b_2 is a secondary coefficient. The second linear combination, also denoted LC_2, may be defined by primary coefficient a_2 and secondary coefficient b_2. The second linear combination may be different from the first linear combination. Different linear combinations or different mixing of primary mixer input and secondary mixer for different components, e.g. in different frequency bands, may further optimize the spatial perception for the hearing device user, since feedback and instability in general depends on frequency. Thus, the present disclosure allows for increased use of the secondary microphone (high coefficient) in frequency bands where the feedback is low which may lead to improved spatial perception. Further, a low secondary coefficient may be used in frequency bands with severe feedback challenges. The sum of a_2 and b_2 may be 1.

In one or more exemplary hearing devices, the primary coefficient a_2 may be in the range between 0.1 and 0.9. and/or the secondary coefficient b_2 may be in the range between 0.1 and 0.9. The secondary coefficient b_2 may be less than 0.5. The secondary coefficient b_2 may be different from the secondary coefficient b_1.

In or more exemplary hearing devices, the secondary coefficient b_1 is larger than 0.5, such as in the range from 0.55 to 0.95 and/or the secondary coefficient b_2 is less than 0.5, such as in the range from 0.05 to 0.45.

In one or more exemplary hearing devices and/or methods, to increase an amount of the secondary mixer input for a time period may comprise increasing the secondary coefficient b_1 of the first linear combination, e.g. from a value less than 0.9 to 1, and/or increasing the secondary coefficient b_2 of the second linear combination, e.g. from a value less than 0.9 to 1. To increase an amount of the secondary mixer input for a time period may comprise setting one or more secondary coefficient(s), such as b_1 and/or b_2, to a value larger than 0.5, such as 1 or in the range from 0.6 to 1.

In one or more exemplary hearing devices and/or methods, to reduce the amount of the secondary mixer input in the mixer output after the time period may comprise reducing the secondary coefficient b_1 of the first linear combination, e.g. from a value of 1 to less than 0.9, and/or the secondary coefficient b_2 of the second linear combination, e.g. from a value of 1 to less than 0.9. To reduce an amount of the secondary mixer input after the time period may comprise setting one or more secondary coefficient(s), such as b_1 and/or b_2, to a value less than 0.5, such as 0 or in the range from 0 to 0.4.

In one or more exemplary hearing devices/methods, to reduce an amount of the primary mixer input in the mixer output for a time period may comprise reducing the primary coefficient a_1 of the first linear combination and/or the primary coefficient a_2 of the second linear combination. To reduce an amount of the primary mixer input for a time period may comprise setting one or more primary coefficient(s), such as a_1 and/or a_2, to a value less than 0.5, such as 0 or in the range from 0 to 0.4.

In one or more exemplary hearing devices/methods, to increase the amount of the primary mixer input in the mixer output after the time period may comprise increasing the primary coefficient a_1 of the first linear combination and/or increasing the primary coefficient a_2 of the second linear combination. To increase an amount of the primary mixer input after the time period may comprise setting one or more primary coefficient(s), such as a_1 and/or a_2, to a value larger than 0.5, such as 1 or in the range from 0.6 to 1.

In one or more exemplary hearing devices, the mixing module is configured to mix a primary third component, also denoted x_p_3, of the primary mixer input and a secondary third component, also denoted x_s_3, of the secondary mixer input for provision of a third component, also denoted y_3, of the mixer output.

The primary third component of the primary mixer input and the secondary third component of the secondary mixer input may be components of a third frequency band or third frequency bin. In one or more exemplary hearing devices/methods, a center frequency of the third frequency band/frequency bin is less than 1 kHz or even less than 400 Hz. A center frequency of the third frequency band/frequency bin may be in a range from 400 Hz to 2 kHz. In one or more exemplary hearing devices/methods, a center frequency of the third frequency band/frequency bin is larger than 1 kHz, such as larger than 2 kHz or even larger than 3 kHz. The third frequency band/frequency bin may be different from the first frequency band/frequency bin and/or different from the second frequency band/frequency bin.

In one or more exemplary hearing devices, to mix the primary third component of the primary mixer input and the secondary third component of the secondary mixer input comprises to apply a third linear combination to the primary third component and the secondary third component for provision of the third component of the mixer output. In other words, the third component y_3 of the mixer output may be given as:

$$y_3=a_3*x_p_3+b_3*x_s_3,$$

where a_3 is a primary coefficient and b_3 is a secondary coefficient. The third linear combination, also denoted LC_3, may be defined by primary coefficient a_3 and secondary coefficient b_3. The third linear combination may be different from the first linear combination.

In one or more exemplary hearing devices, the primary coefficient a_3 may be in the range between 0.1 and 0.9. and/or the secondary coefficient b_3 may be in the range between 0.1 and 0.9. The secondary coefficient b_3 may be larger than 0.5. The secondary coefficient b_3 may be different from the secondary coefficient b_1 and/or different from the secondary coefficient b_2. The sum of a_3 and b_3 may be 1.

In one or more exemplary hearing devices and/or methods, to increase an amount of the secondary mixer input for a time period may comprise increasing the secondary coefficient b_3 of the third linear combination, e.g. from a value less than 0.9 to 1. To increase an amount of the secondary mixer input for a time period may comprise setting secondary coefficient b_3 to a value larger than 0.5, such as 1 or in the range from 0.6 to 1.

In one or more exemplary hearing devices and/or methods, to reduce the amount of the secondary mixer input in the mixer output after the time period may comprise reducing the secondary coefficient b_3 of the third linear combination, e.g. from a value of 1 to less than 0.9. To reduce an amount of the secondary mixer input after the time period may comprise setting secondary coefficient b_3 to a value less than 0.5, such as 0 or in the range from 0 to 0.4.

In one or more exemplary hearing devices/methods, to reduce an amount of the primary mixer input in the mixer output for a time period may comprise reducing the primary coefficient a_3 of the third linear combination. To reduce an amount of the primary mixer input for a time period may comprise setting primary coefficient a_3 to a value less than 0.5, such as 0 or in the range from 0 to 0.4.

In one or more exemplary hearing devices/methods, to increase the amount of the primary mixer input in the mixer output after the time period may comprise increasing the primary coefficient a_3 of the third linear combination. To increase an amount of the primary mixer input after the time period may comprise setting primary coefficient a_3 to a value larger than 0.5, such as 1 or in the range from 0.6 to 1.

Further, it is an important advantage of the present disclosure that the linear combinations/mixing filters may be individually set during operation of the hearing device and configured to the specific hearing device user environments. Thereby, improved hearing device operation/listening experience is provided. In particular, a hearing device with improved directionality is provided.

In one or more exemplary hearing devices, the mixing module is configured to mix primary components x_p_i, of the primary mixer input and secondary components x_s_i of the secondary mixer input for provision of components y_i of the mixer output, e.g. by application of linear combinations LC_i=(a_i, b_i), where i is an index of the i'th component of the respective mixer inputs, mixer output and linear combinations defined by primary and secondary coefficients. In other words, the mixer output components y_i, i=1 to N (N is the number of components/frequency bands) may be given as:

$$y_i=a_i*x_p_i+b_i*x_i$$

The number i of frequency bands/components may be larger than five, such as larger than fifteen. The sum of a_i and b_i may be 1 for one or more, such as all i=1 to N.

In one or more exemplary hearing devices/methods, a_i and b_i are complementary, i.e. a_i+b_i=1 at least for one or a plurality, such as all, of i=1, 2, . . . , N.

In one or more exemplary hearing devices/methods, one or a plurality, such as all, of primary coefficients a_i, e.g. for i=1, 2 and 3, may be 0 during the time period and/or larger than 0, such as larger than 0.1, after the time period. In one or more exemplary hearing devices/methods, one or a plurality, such as all, of primary coefficients a_i, e.g. for i=1, 2 and 3, may be larger than 0, such as larger than 0.1, before detection of a switch event/sound event.

In one or more exemplary hearing devices/methods, one or a plurality, such as all, of secondary coefficients b_i, e.g. for i=1, 2 and 3, may be 1 at least during the time period and/or less than 1, such as less than 0.9, after the time period. In one or more exemplary hearing devices/methods, one or a plurality, such as all, of secondary coefficients b_i, e.g. for i=1, 2 and 3, may be less than 1, such as less than 0.9, before detection of a switch event/sound event.

In one or more exemplary hearing devices/methods, one or a plurality, such as all, of primary coefficients a_i, e.g. for i=1, 2, and 3, may be in the range from 0.1 to 0.9 or less than 0.1 during the time period and/or in the range from 0.1 to 0.9 and/or larger than 0.1 after the time period. For example, primary coefficients a_i, e.g. for i=1, 2, and 3, may be less than 0.1 during the time period and larger than 0.1 (and optionally less than 0.9) after the time period.

In one or more exemplary hearing devices/methods, one or a plurality, such as all, of secondary coefficients b_i, e.g. for i=1, 2, and 3, may be in the range from 0.1 to 0.9 or larger than 0.9 during the time period and/or in the range from 0.1 to 0.9 or less than 0.9 after the time period. For example, secondary coefficients b_i, e.g. for i=1, 2, and 3, may be larger than 0.9 during the time period and less than 0.9 (and optionally larger than 0.1) after the time period.

It is to be noted that features described in relation to the hearing device are also applicable to the method and vice versa.

FIG. 1 shows exemplary hearing devices. The hearing device 2, 2A comprises a first housing 4 configured as a behind-the-ear housing to be worn behind the pinna of a user; a second housing 6 configured as an earpiece housing to be worn in or at the ear canal of a user; and a wire 8 connecting the first housing 4 and the second housing 6. The hearing device 2, 2A comprises a primary set of microphones 10, 12 arranged in the first housing 4, the primary set of microphones including a primary first microphone 10 for provision of a primary first microphone input signal 10A, and a primary second microphone 12 for provision of a primary second microphone input signal 12A. The hearing device 2, 2A comprises a secondary microphone 14 arranged in the second housing 6 for provision of a secondary microphone input signal 14A.

The hearing device 2, 2A comprises a mixing module 16 for provision of a mixer output 18 based on a primary mixer input 20 and a secondary mixer input 22, wherein the primary mixer input 20 is optionally based on the primary first microphone input signal 10A and/or the primary second microphone input signal 12A, and the secondary mixer input 22 is based on the secondary microphone input signal 14A.

The hearing device 2, 2A comprises a processor 24 for processing the mixer output 18 and providing an electrical output signal 26 based on mixer output 18; and a receiver 28 for converting the electrical output signal 26 to an audio output signal.

In hearing device 2, the mixing module 16 comprises a primary mixing filter 30 and a secondary mixing filter 32 for filtering broadband primary mixer input 20 and broadband secondary mixer input 22, respectively, in the time-domain. Filtered primary mixer input 33A and filtered secondary mixer input 33B are fed to adder 34 of the mixing module 16 for forming the mixer output 18. Accordingly, the mixing module 16 is configured to mix a broadband primary first component of the primary mixer input 20 and a secondary first component of the secondary mixer input 22 for provision of a broadband first component of the mixer output 18.

In hearing device 2A, the mixing module 16A comprises a primary gain unit 30A and a secondary gain unit 32A for applying respective gains or coefficients of first linear combination to broadband primary mixer input 20 and broadband secondary mixer input 22, respectively, in the time-domain. The outputs from gain units 30A and 32A are fed to adder 34 of the mixing module 16 for forming the mixer output 18. Optionally, the mixing module 16A is configured to mix a broadband primary first component of the primary mixer input 20 and a secondary first component of the secondary mixer input 22 for provision of a broadband first component of the mixer output 18 by applying a first linear combination to broadband primary first component as primary mixer input 20 and broadband secondary first component as secondary mixer input 22 for provision of broadband first component as mixer output 18. In other words, the primary gain unit 30A applies a primary coefficient a_1 as a primary gain to the primary mixer input 20 and the secondary gain unit 32A applies a secondary coefficient b_1 as a secondary gain to the secondary mixer input 22. The primary coefficient may be in the range from 0.1 to 0.9 and/or the secondary coefficient may be in the range from 0.1 to 0.9.

The hearing device 2, 2A may comprise a primary pre-processor 36 for forming the primary mixer input 20 based on the primary first microphone input signal 10A and/or the primary second microphone input signal 12A. In the primary pre-processer 36, a first filter 36A optionally filters primary first microphone input signal 10A and a second filter 36B optionally filters the primary second microphone input signal 12A. The (optionally filtered) primary first microphone input signal 10A and the (optionally filtered) primary second microphone input signal 12A are fed to adder 36C for forming the primary mixer input 20 as the sum of (optionally filtered) primary first microphone input signal 10A and (optionally filtered) primary second microphone input signal 12A. The first filter 36A and the second filter 36B may be pinna-restoration filters.

The hearing device 2 and/or the hearing device, 2A may comprise a secondary pre-processor 38 for forming the secondary mixer input 22 based on the secondary microphone input signal 14A. The secondary microphone input signal 14A may be fed to the respective mixing module 16, 16A as the secondary mixer input. In the secondary pre-processer 38, a filter and/or a delay 36A optionally filters and/or delays secondary microphone input signal 14A for provision of secondary mixer input 22, e.g. for the secondary mixer input 22 to match the primary mixer input 20.

The hearing device 2 and/or the hearing device 2A comprises a mixing controller 44 configured to determine presence of a switch or sound event e.g. with switch detector 45; in accordance with a determination that a sound event is present, increase an amount of the secondary mixer input in the mixer output for a time period, e.g. by increasing amplitude of filter transfer function of secondary mixing filter 32 or increasing gains/coefficients of secondary gain unit 32A; and reduce the amount of the secondary mixer input in the mixer output after the time period, e.g. by reducing amplitude of filter transfer function of secondary mixing filter 32 or reducing gains/coefficients of secondary gain unit 32A. In other words, the mixing controller sends a control signal 52 with control parameter(s) to control the mixing module 16, 16A, e.g. for controlling filter coefficients or gains in the mixing module. The time period may be adaptive and/or be in the range from 2 ms to 20 ms, such as in the range 5 ms to 15 ms.

The mixing controller 44 may be configured to determine the control parameter(s), e.g. based on one or more operating parameters of the hearing device, e.g. from processor 24 as indicated by dashed conductor 46 and/or one or both of electrical output signal 26 and secondary microphone input signal 14A as indicated by respective dashed conductors 48, 50. In one or more exemplary hearing devices, the primary first microphone input signal 10A and/or primary second microphone input signal 12A (or filtered versions thereof) is fed to the mixing controller 44 for determining presence of a switch event/sound event based on the primary first microphone input signal 10A and/or primary second microphone input signal 12A. Primary mixer input 20 and/or secondary mixer input 22 may be fed to the mixing controller 44 for optionally determining presence of a switch event/sound event based on one or both of these inputs 20, 22.

Accordingly, the mixing controller 44 may be configured to determine the presence of a sound event is based on one or more of the primary first microphone input signal 10A, the primary second microphone input signal 12A, and the secondary microphone input signal 14A.

The mixing controller 44 controls the mixing module 16, 16A, e.g. by setting filter coefficient(s) or coefficients of mixing filters 30, 32 or gain units 30A, 32A, respectively with control signal 52.

The mixing controller 44 may be configured to determine the time period based on one or more operating parameters, such as program identifier, gain(s), feedback parameter(s), of the hearing device optionally received from processor 24 via conductor 46.

The mixing controller 44 may be configured to increase an amount of the secondary mixer input in the mixer output and determine if a switching criterion is satisfied, i.e. to increase an amount of the secondary mixer input in the mixer output for a time period optionally comprises to increase an amount of the secondary mixer input in the mixer output and determine if a switching criterion is satisfied. The switching criterion evaluated in the mixing controller 44 may be based on one or more gains, such as a closed-loop gain, and/or feedback parameters of the hearing device. In other words, the hearing device may use an increased amount of secondary mixer input in the mixer output until the mixing controller determines that instability is either present or imminent. For example, the switching criterion may be satisfied if a feedback parameter indicative of the risk of feedback reaches a threshold. The switching criterion may be satisfied if a closed-loop gain reaches a threshold. Optionally, to reduce the amount of the secondary mixer input in the mixer output after the time period comprises to reduce the amount of the secondary mixer input in the mixer output in accordance with the mixing controller 44 determining that the switching criterion is satisfied. In other words, the mixing controller 44 may be configured to reduce the amount of the secondary mixer input in the mixer output in accordance with a determination that the switching criterion is satisfied.

Figure 2:
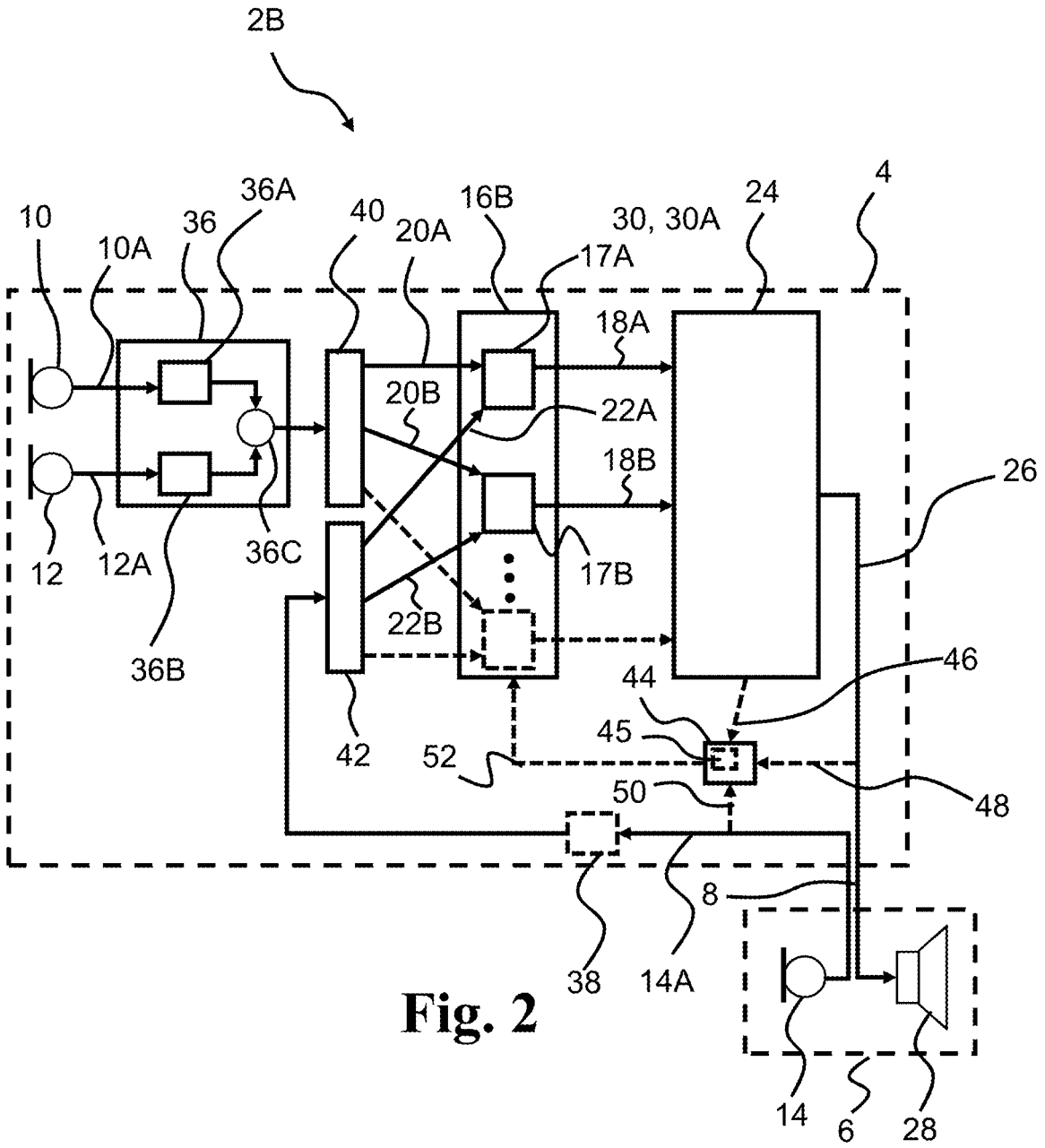
FIG. 2 schematically illustrates an exemplary hearing device.

FIG. 2 shows a hearing device with multi-band mixing module. The hearing device 2B comprises a primary filter-bank 40 for provision of a multi-band primary mixer input comprising N components of the primary mixer input including primary first component 20A and primary second component 20B of primary mixer input based on microphone input signals 10A and 12A. The hearing device 2B comprises a secondary filter-bank 42 for provision of a multi-band secondary mixer input comprising N components of the secondary mixer input (N may be larger than 5 or larger than 15) including secondary first component 22A and secondary second component 22B of secondary mixer input based on microphone input signal 14A.

The mixing module 16B comprises a first linear combiner 17A configured to mix primary first component 20A and secondary first component 22A by applying a first linear combination defined by primary coefficient a_1 and secondary coefficient b_1 to respective components 20A, 22A for provision of a first component 18A of the mixer output. The mixing module 16B comprises a second linear combiner 17B configured to mix primary second component 20B and secondary second component 22B by applying a second linear combination defined by primary coefficient a_2 and secondary coefficient b_2 to respective components 20B, 22B for provision of a second component 18B of the mixer output. The mixing module 16B may comprise N linear combiners including N'th linear combiner 17C configured to mix respective N primary and secondary components for provision of N components of the mixer output. The second linear combination is different from the first linear combination.

The hearing device 2B optionally comprises a mixing controller 44 as described in relation to FIG. 1, e.g. configured to apply a mixing scheme in the mixing module 16B.

The mixing controller 44 controls the mixing module 16B, e.g. by setting linear combinations/coefficients of linear combiners 17A, 17B, . . . , 17C with control signal 52, e.g. according to determination of a switch event/sound event. In other words, the mixing controller 44 optionally increases and/or reduces the amount of the secondary mixer input in the mixer output by setting linear combinations/coefficients of linear combiners 17A, 17B, . . . , 17C with control signal 52.

Figure 3:
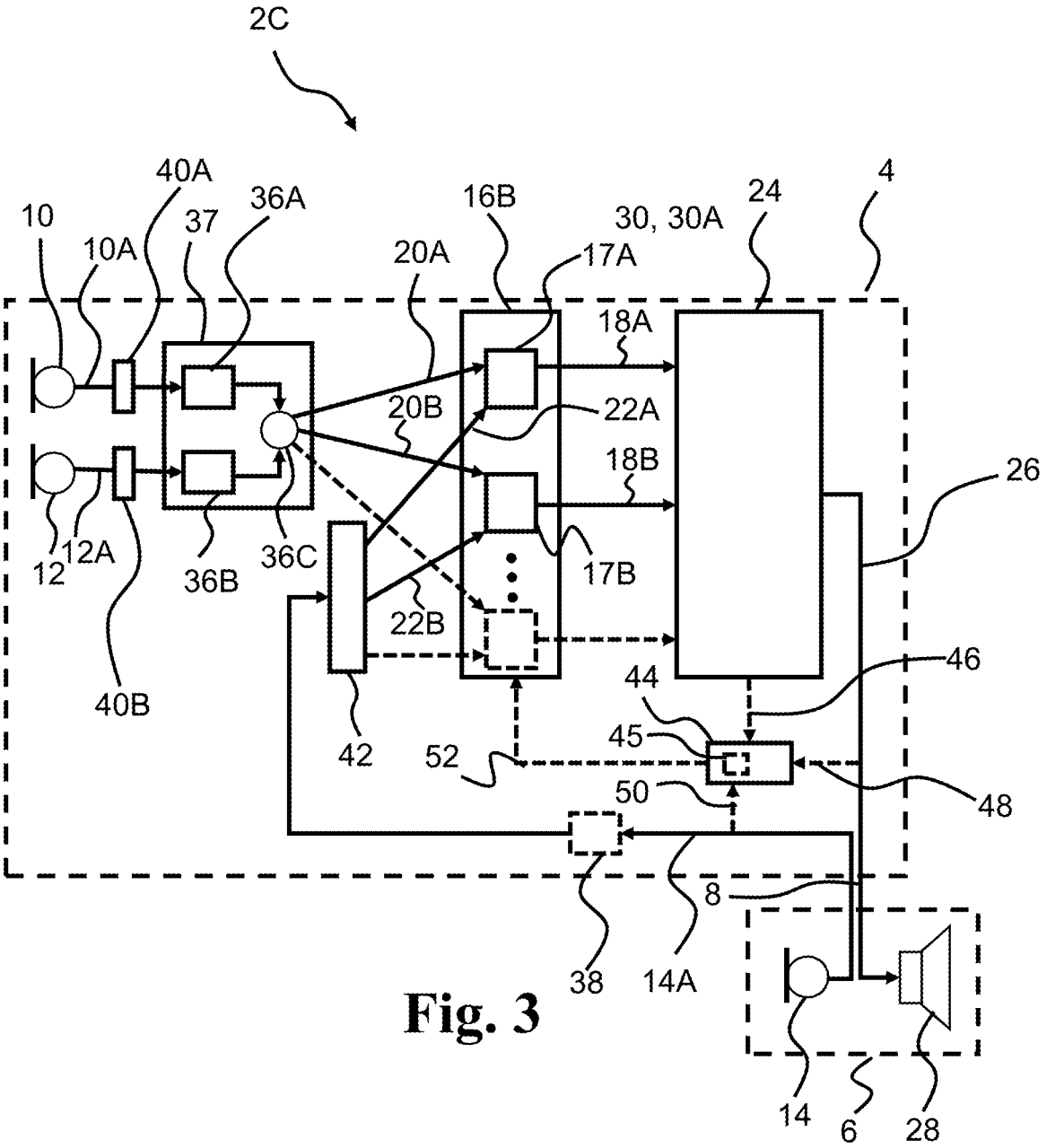
FIG. 3 schematically illustrates an exemplary hearing device.

FIG. 3 shows a hearing device with multi-band primary pre-processor 37 and multi-band mixing module 16B. The hearing device 2C comprises a primary first filter-bank 40A for provision of a multi-band primary first microphone input signal comprising N components that are fed to multiband pre-processor 37. The hearing device 2C comprises a primary second filter-bank 40B for provision of a multi-band primary second microphone input signal comprising N components that are fed to multiband pre-processor 37. The first filter 36A, the second filter 36B and adder 36C of pre-processor 37 are multi-band implementations for provision of multi-band primary mixer input. Thereby, multi-band pinna restoration and multiband mixing is provided, which in turn may increase the user experience by improving directional or spatial cues with reduced howling and/or feedback.

Figure 4:
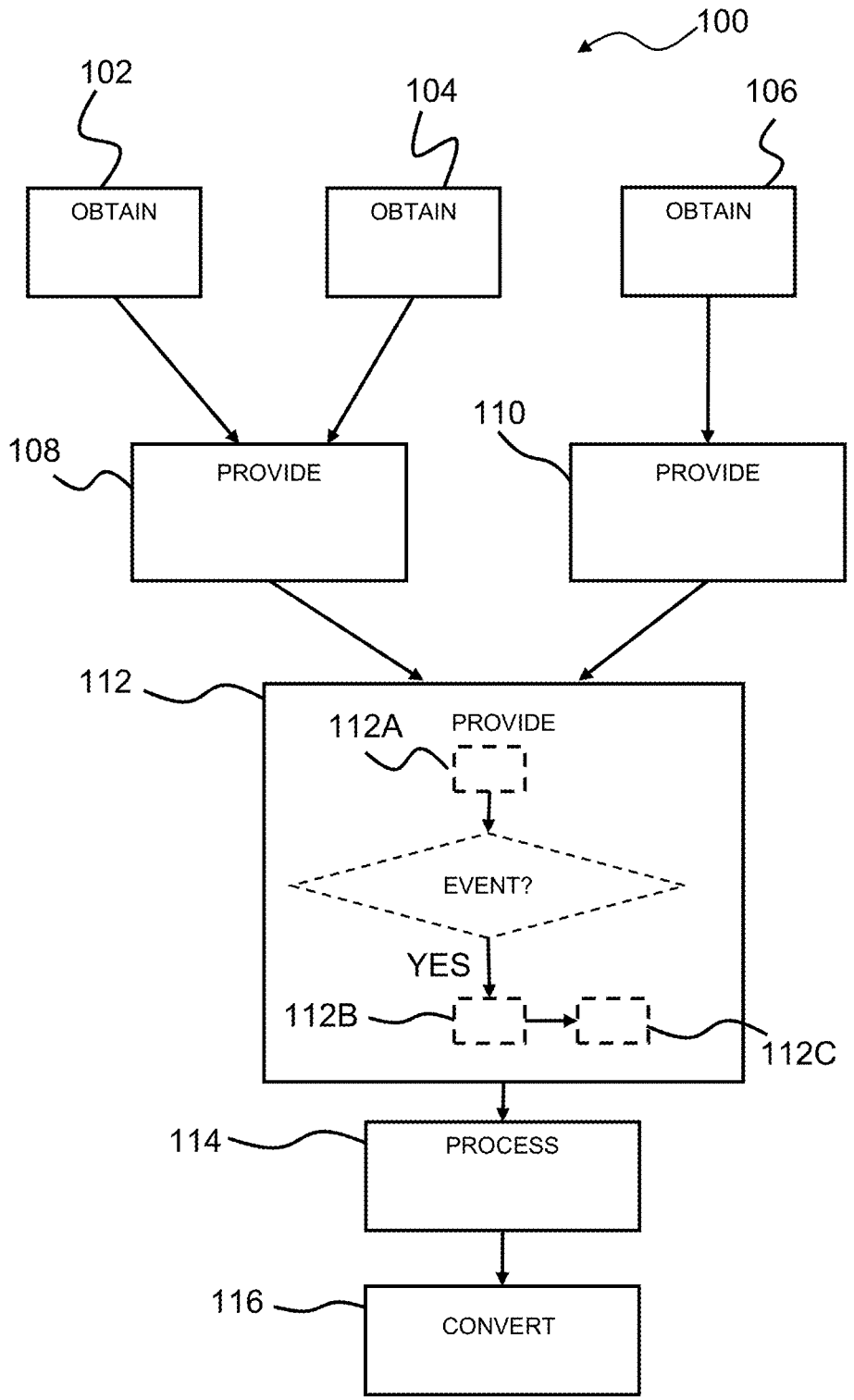
FIG. 4 is a flow diagram of an exemplary method according to the disclosure.

FIG. 4 is a flow diagram of an exemplary method of operating a hearing device, the hearing device comprising a first housing configured as a behind-the-ear housing to be worn behind the pinna of a user; a second housing configured as an earpiece housing to be worn in or at the ear canal of a user; a wire connecting the first housing and the second housing; a primary set of microphones arranged in the first housing, the primary set of microphones including a primary first microphone and a primary second microphone; a secondary microphone arranged in the second housing; a mixing module; a mixing controller; a processor; and a receiver, the method 100 comprising obtaining 102 a primary first microphone input signal with the primary first microphone; obtaining 104 a primary second microphone input signal with the primary second microphone; obtaining 106 a secondary microphone input signal with the secondary microphone; providing 108 a primary mixer input based on the primary first microphone input signal and/or the primary second microphone input signal; providing 110 a secondary mixer input based on the secondary microphone input signal; providing 112 a mixer output based on the primary mixer input and the secondary mixer input; processing 114 the mixer output for provision of an electrical output signal; and converting 116 the electrical output signal to an audio output signal. In the method 100, providing 112 a mixer output based on the primary mixer input and the secondary mixer input comprises determining 112 presence of a sound event or a switch event; in accordance with determining presence of a sound event, increasing 112B an amount of the secondary mixer input in the mixer output for a time period; and reducing 112C the amount of the secondary mixer input in the mixer output after the time period. Increasing 112B an amount of the secondary mixer input in the mixer output for a time period optionally comprises reducing an amount of the primary mixer input in the mixer output for a time period. Reducing 112C the amount of the secondary mixer input in the mixer output after the time period optionally comprises increasing the amount of the primary mixer input in the mixer output after the time period.

Figure 5:
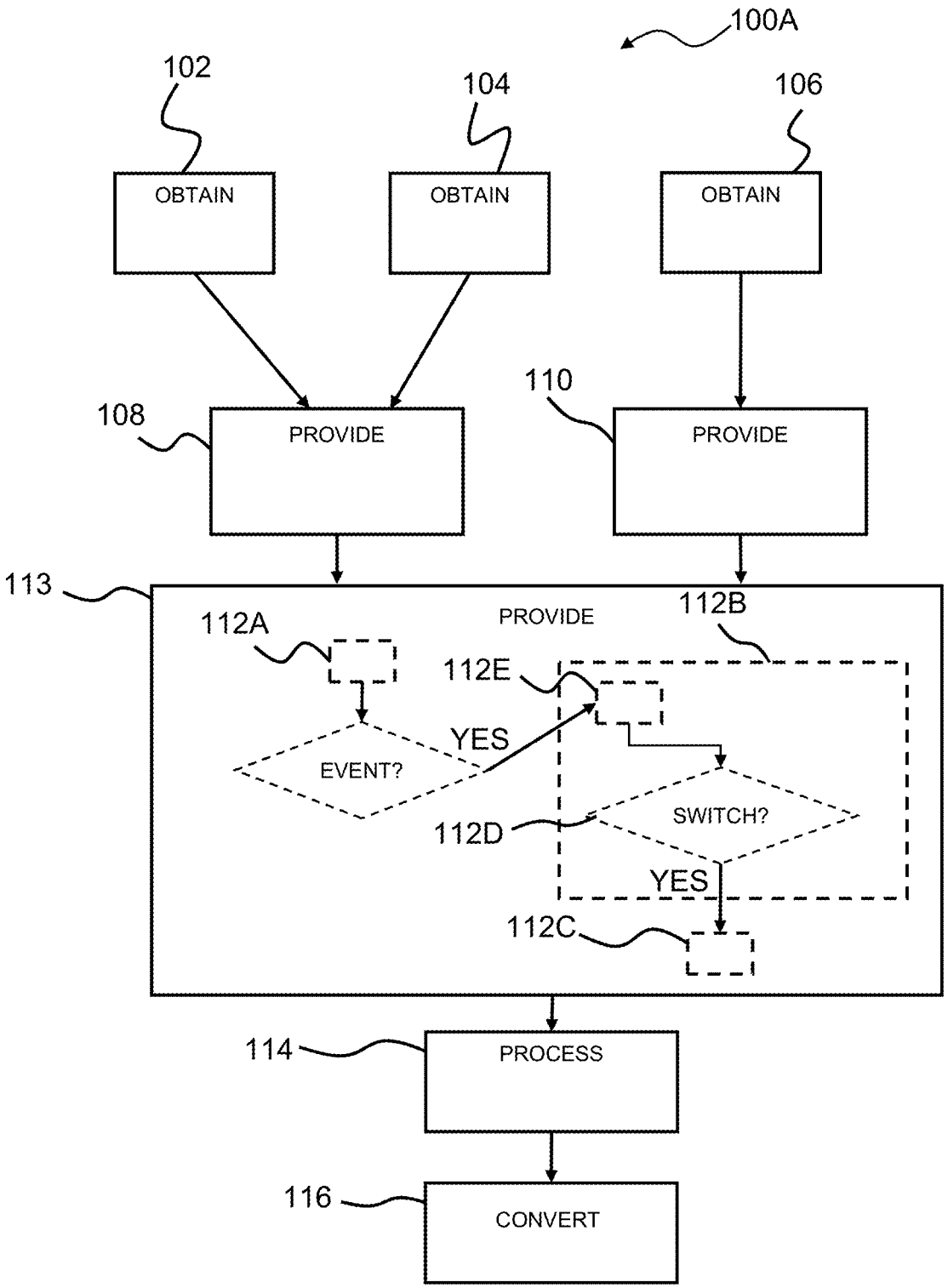
FIG. 5 is a flow diagram of an exemplary method according to the disclosure.

FIG. 5 is a flow diagram of an exemplary method 100A of operating a hearing device. The method 100A comprises providing 113 a mixer providing a mixer output based on the primary mixer input and the secondary mixer input including increasing 112B an amount of the secondary mixer input in accordance with determining presence of a sound event. In the method 100A, increasing 112B an amount of the secondary mixer input in the mixer output for a time period comprises increasing 112E an amount of the secondary mixer input in the mixer output and determine 112D if a switching criterion is satisfied, and wherein reducing 112C the amount of the secondary mixer input in the mixer output after the time period comprises reducing 112C the amount of the secondary mixer input in the mixer output in accordance with a determination that the switching criterion is satisfied.

Figure 6:
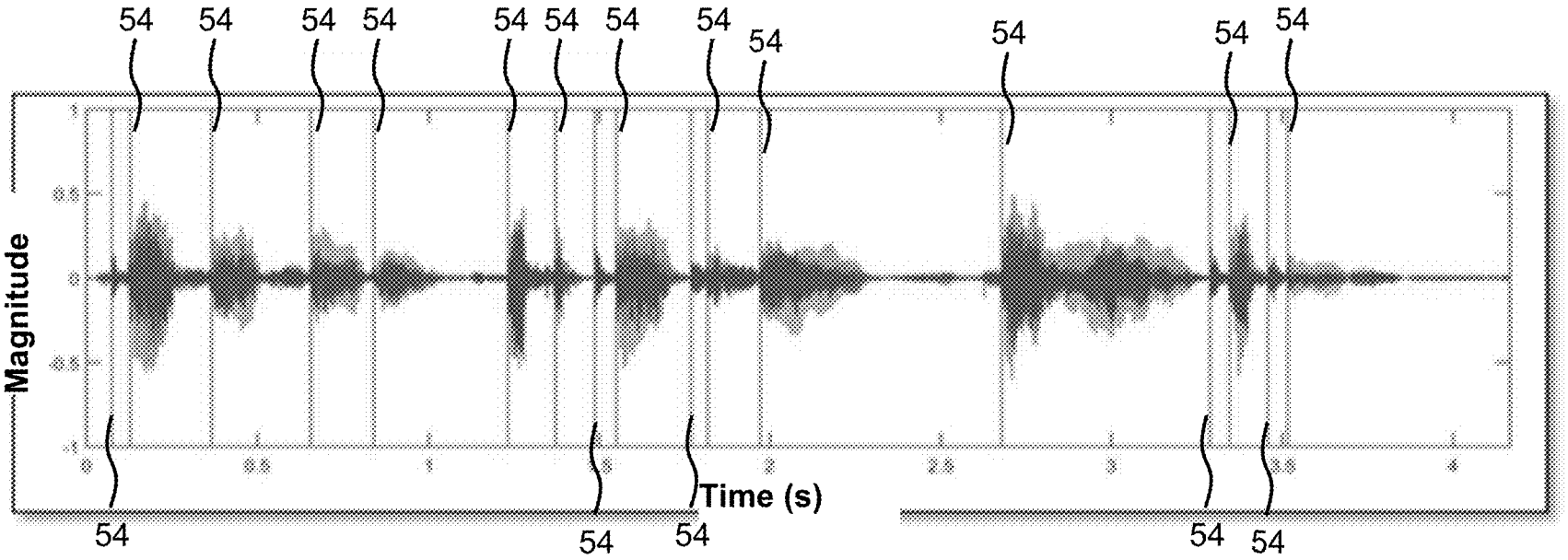
FIG. 6 illustrates sound events in speech.

FIG. 6 shows an example of 4 seconds of speech (3 speakers in a reverberant room). The red lines 54 indicate instants of sound events in the speech, i.e. the mixing controller determines presence of a sound event at time instants indicated by the red lines and increases an amount of the secondary mixer input in the mixer output for a time period, e.g. by switching to only use the secondary mixer input in the mixer output or increasing one or more of the coefficients/gains applied to the secondary mixer input in the mixing module.

The use of the terms "first", "second", "third" and "fourth", "primary", "secondary", "tertiary" etc. does not imply any particular order, but are included to identify individual elements. Moreover, the use of the terms "first", "second", "third" and "fourth", "primary", "secondary", "tertiary" etc. does not denote any order or importance, but rather the terms "first", "second", "third" and "fourth", "primary", "secondary", "tertiary" etc. are used to distinguish one element from another. Note that the words "first", "second", "third" and "fourth", "primary", "secondary", "tertiary" etc. are used here and elsewhere for labelling purposes only and are not intended to denote any specific spatial or temporal ordering.

Furthermore, the labelling of a first element does not imply the presence of a second element and vice versa.

It may be appreciated that FIGS. 1-6 comprise some modules or operations which are illustrated with a solid line and some modules or operations which are illustrated with a dashed line. The modules or operations which are comprised in a solid line are modules or operations which are comprised in the broadest example embodiment. The modules or operations which are comprised in a dashed line are example embodiments which may be comprised in, or a part of, or are further modules or operations which may be taken in addition to the modules or operations of the solid line example embodiments. It should be appreciated that these operations need not be performed in order presented. Furthermore, it should be appreciated that not all of the operations need to be performed. The exemplary operations may be performed in any order and in any combination.

It is to be noted that the word "comprising" does not necessarily exclude the presence of other elements or steps than those listed.

It is to be noted that the words "a" or "an" preceding an element do not exclude the presence of a plurality of such elements.

It should further be noted that any reference signs do not limit the scope of the claims, that the exemplary embodiments may be implemented at least in part by means of both hardware and software, and that several "means", "units" or "devices" may be represented by the same item of hardware.

The various exemplary methods, devices, and systems described herein are described in the general context of method steps processes, which may be implemented in one aspect by a computer program product, embodied in a computer-readable medium, including computer-executable instructions, such as program code, executed by computers in networked environments. A computer-readable medium may include removable and non-removable storage devices including, but not limited to, Read Only Memory (ROM), Random Access Memory (RAM), compact discs (CDs), digital versatile discs (DVD), etc. Generally, program modules may include routines, programs, objects, components, data structures, etc. that perform specified tasks or implement specific abstract data types. Computer-executable instructions, associated data structures, and program modules represent examples of program code for executing steps of the methods disclosed herein. The particular sequence of such executable instructions or associated data structures represents examples of corresponding acts for implementing the functions described in such steps or processes.

Although features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications, and equivalents.

LIST OF REFERENCES

2, 2A, 2B, 2C hearing device
4 first housing
6 second housing
8 wire
10 primary first microphone
10A primary first microphone input signal
12 primary second microphone
12A primary second microphone input signal
14 secondary microphone
14A secondary microphone input signal
16, 16A, 16B mixing module
17A first linear combiner
17B second linear combiner
17C N'th linear combiner
18 mixer output
18A first component of mixer output
18B second component of mixer output
20 primary mixer input
20A primary first component of primary mixer input
20B primary second component of primary mixer input
22 secondary mixer input
22A secondary first component of secondary mixer input
22B secondary second component of secondary mixer input
24 processor
26 electrical output signal
28 receiver
30 primary mixing filter
30A primary gain unit
32 secondary mixing filter
32A secondary gain unit
33A filtered primary mixer input
33B filtered secondary mixer input
34 adder
36, 37 primary pre-processor
36A first filter
36B second filter
36C adder
38 secondary pre-processor
40 primary filter-bank
40A primary first filter-bank
40B primary second filter-bank
42 secondary filter-bank
44 mixing controller
46 conductor
48 conductor
50 conductor
52 control signal
54 sound event
100, 100A method of operating a hearing device
102 obtaining a primary first microphone input signal
104 obtaining a primary second microphone input signal
106 obtaining a secondary microphone input signal
108 providing a primary mixer input
110 providing a secondary mixer input
112, 113 providing a mixer output
112A determining presence of a sound event
112B increasing an amount of the secondary mixer input in accordance with determining presence of a sound event
112C reducing the amount of the secondary mixer input in the mixer output after the time period
112D determining if a switching criterion is satisfied
112E increasing an amount of the secondary mixer input
114 processing the mixer output for provision of an electrical output signal; and
116 converting the electrical output signal to an audio output signal,

The invention claimed is:

1. A hearing device comprising:

a first housing configured to be worn behind a pinna of a user;

a second housing configured to be worn in an ear canal or at an ear of the user;

an elongated member extending between the first housing and the second housing;

a first primary microphone in the first housing for provision of a first primary microphone input signal, and a second primary microphone in the first housing for provision of a second primary microphone input signal;

a secondary microphone in the second housing for provision of a secondary microphone input signal;

a mixing module for provision of a mixer output based on a primary mixer input and/or a secondary mixer input, wherein the primary mixer input is based on the first primary microphone input signal and the second primary microphone input signal, and the secondary mixer input is based on the secondary microphone input signal;

a mixing controller configured to control the mixing module;

a processing unit configured to process the mixer output and to provide an electrical output signal; and a receiver for converting the electrical output signal to an audio output signal;

wherein the mixing controller is configured to:

determine a presence of a sound event;

increase an amount of the secondary mixer input in the mixer output for a time period after the presence of the sound event is determined, wherein the time period is anywhere in a range from 5 ms to 15 ms; and reduce the amount of the secondary mixer input in the mixer output after the time period.

2. The hearing device according to claim 1, wherein the mixing controller is configured to determine the presence of the sound event based on the first primary microphone input signal, the second primary microphone input signal, the secondary microphone input signal, or any combination of the foregoing.

3. A hearing device comprising:

a first housing configured to be worn behind a pinna of a user;

a second housing configured to be worn in an ear canal or at an ear of the user;

an elongated member extending between the first housing and the second housing;

a first primary microphone in the first housing for provision of a first primary microphone input signal, and a second primary microphone in the first housing for provision of a second primary microphone input signal;

a secondary microphone in the second housing for provision of a secondary microphone input signal;

a mixing module for provision of a mixer output based on a primary mixer input and/or a secondary mixer input, wherein the primary mixer input is based on the first primary microphone input signal and the second primary microphone input signal, and the secondary mixer input is based on the secondary microphone input signal;

a mixing controller configured to control the mixing module;

a processing unit configured to process the mixer output and to provide an electrical output signal; and a receiver for converting the electrical output signal to an audio output signal;

wherein the mixing controller is configured to:

determine a presence of a sound event;

increase an amount of the secondary mixer input in the mixer output for a time period after the presence of the sound event is determined; and reduce the amount of the secondary mixer input in the mixer output after the time period; and wherein the mixing controller is configured to determine the time period based on one or more operating parameters of the hearing device.

4. A hearing device comprising:

a first housing configured to be worn behind a pinna of a user;

a second housing configured to be worn in an ear canal or at an ear of the user;

an elongated member extending between the first housing and the second housing;

a first primary microphone in the first housing for provision of a first primary microphone input signal, and a second primary microphone in the first housing for provision of a second primary microphone input signal;

a secondary microphone in the second housing for provision of a secondary microphone input signal;

a mixing module for provision of a mixer output based on a primary mixer input and/or a secondary mixer input, wherein the primary mixer input is based on the first primary microphone input signal and the second primary microphone input signal, and the secondary mixer input is based on the secondary microphone input signal;

a mixing controller configured to control the mixing module;

a processing unit configured to process the mixer output and to provide an electrical output signal; and a receiver for converting the electrical output signal to an audio output signal;

wherein the mixing controller is configured to:

determine a presence of a sound event;

increase an amount of the secondary mixer input in the mixer output for a time period after the presence of the sound event is determined; and reduce the amount of the secondary mixer input in the mixer output after the time period; and wherein the mixing controller is configured to determine if a switching criterion is satisfied, and wherein the mixing controller is configured to reduce the amount of the secondary mixer input in the mixer output after the time period in accordance with a determination that the switching criterion is satisfied.

5. The hearing device according to claim 1, wherein the mixing controller is configured to increase the amount of the secondary mixer input in the mixer output for a time period by not using the first mixer input for at least a component of the mixer output.

6. The hearing device according to claim 1, wherein the mixing controller is configured to increase the amount of the secondary mixer input in the mixer output for the time period by increasing a coefficient applied to a component of the secondary mixer input.

7. The hearing device according to claim 1, wherein the mixing controller is configured to reduce the amount of the secondary mixer input in the mixer output after the time period by gradually reducing a secondary coefficient applied to a component of the secondary mixer input.

8. The hearing device according to claim 1, wherein the mixing controller is configured to reduce the amount of the secondary mixer input in the mixer output after the time period by changing a coefficient being applied to a component of the secondary mixer input.

9. A hearing device comprising:

a first housing configured to be worn behind a pinna of a user;

a second housing configured to be worn in an ear canal or at an ear of the user;

an elongated member extending between the first housing and the second housing;

a first primary microphone in the first housing for provision of a first primary microphone input signal, and a second primary microphone in the first housing for provision of a second primary microphone input signal;

a secondary microphone in the second housing for provision of a secondary microphone input signal;

a mixing module for provision of a mixer output based on a primary mixer input and/or a secondary mixer input, wherein the primary mixer input is based on the first primary microphone input signal and the second primary microphone input signal, and the secondary mixer input is based on the secondary microphone input signal;

a mixing controller configured to control the mixing module;

a processing unit configured to process the mixer output and to provide an electrical output signal; and a receiver for converting the electrical output signal to an audio output signal;

wherein the mixing controller is configured to:

determine a presence of a sound event;

increase an amount of the secondary mixer input in the mixer output for a time period after the presence of the sound event is determined; and reduce the amount of the secondary mixer input in the mixer output after the time period; and wherein the mixing controller is configured to increase the amount of the secondary mixer input in the mixer output for the time period by:

determining a coefficient based on one or more operating parameters of the hearing device, and applying the coefficient to the secondary mixer input for provision of the mixer output.

10. A method performed by a hearing device, the hearing device comprising a first housing to be worn behind a pinna of a user, a second housing to be worn in an ear canal or at an ear of the user, an elongated member extending between the first housing and the second housing, a first primary microphone and a second primary microphone in the first housing, a secondary microphone in the second housing, and a receiver, the method comprising:

obtaining a first primary microphone input signal with the first primary microphone;

obtaining a second primary microphone input signal with the second primary microphone;

obtaining a secondary microphone input signal with the secondary microphone;

providing a primary mixer input based on the first primary microphone input signal and the second primary microphone input signal;

providing a secondary mixer input based on the secondary microphone input signal;

providing a mixer output based on the primary mixer input and/or the secondary mixer input;

processing the mixer output for provision of an electrical output signal; and converting the electrical output signal to an audio output signal;

wherein the method further comprises determining a presence of a sound event; and wherein the act of providing the mixer output comprises:

increasing an amount of the secondary mixer input in the mixer output for a time period after the presence of the sound event is determined, wherein the time period is anywhere in a range from 5 ms to 15 ms; and reducing the amount of the secondary mixer input in the mixer output after the time period.

11. The hearing device according to claim 1, wherein the sound event comprises a speech event.

12. The hearing device according to claim 3, wherein the time period is anywhere in a range from 5 ms to 15 ms.

13. The hearing device according to claim 3, wherein the sound event comprises a speech event.

14. The hearing device according to claim 4, wherein the time period is anywhere in a range from 5 ms to 15 ms.

15. The hearing device according to claim 4, wherein the sound event comprises a speech event.

16. The hearing device according to claim 9, wherein the time period is anywhere in a range from 5 ms to 15 ms.

17. The hearing device according to claim 9, wherein the sound event comprises a speech event.

18. The method according to claim 10, wherein the sound event comprises a speech event.

19. The method according to claim 10, wherein the presence of the sound event is determined based on the first primary microphone input signal, the second primary microphone input signal, the secondary microphone input signal, or any combination of the foregoing.

* * * * *